US005295585A

United States Patent [19]

Huch

[11] Patent Number: 5,295,585

[45] Date of Patent: Mar. 22, 1994

[54] METHOD FOR ACHIEVING ENHANCED COPPER-CONTAINING MINERAL CONCENTRATE GRADE BY OXIDATION AND FLOTATION

[75] Inventor: Richard O. Huch, Tucson, Ariz.

[73] Assignee: Cyprus Mineral Company, Englewood, Colo.

[21] Appl. No.: 878,444

[22] Filed: May 4, 1992

Related U.S. Application Data

[63] Continuation-in-part of Ser. No. 626,825, Dec. 13, 1990, Pat. No. 5,110,455.

[51] Int. Cl.[5] ..... B03D 1/002; B03D 1/06

[52] U.S. Cl. ..... 209/167; 209/166

[58] Field of Search ..... 209/166, 167, 901; 252/61

[56] References Cited

U.S. PATENT DOCUMENTS

| | | | |
|---|---|---|---|
| 1,397,703 | 11/1921 | Robbins . | |
| 1,554,220 | 9/1925 | Lewis . | |
| 1,690,225 | 11/1928 | Hahn | 209/166 |
| 1,869,532 | 8/1932 | Weinig | 209/167 |
| 1,893,517 | 1/1933 | Gaudin | 209/166 |
| 1,973,558 | 9/1934 | Brinker | 209/167 |
| 2,012,830 | 8/1935 | Ralston et al. | 209/167 |
| 2,559,104 | 7/1951 | Arbiter | 209/166 |
| 2,898,196 | 8/1959 | Forward et al. | 23/224 |
| 3,137,649 | 6/1964 | DeBenedictis et al. | 209/11 |
| 3,426,896 | 2/1969 | Baarson | 209/167 |
| 3,539,002 | 11/1970 | Last | 209/167 |
| 3,655,044 | 4/1972 | Delaney | 209/167 |
| 3,811,569 | 5/1974 | Shirley | 209/167 |
| 3,883,421 | 5/1975 | Cutting | 209/166 |
| 4,006,014 | 2/1977 | Gannon | 75/2 |
| 4,011,072 | 3/1977 | Holman | 209/166 |
| 4,362,552 | 12/1982 | Petrovich | 209/166 |
| 4,425,230 | 1/1984 | Andress | 209/166 |
| 4,561,970 | 12/1985 | Heimala | 209/166 |
| 4,585,549 | 4/1986 | Malghan | 209/166 |
| 4,735,783 | 4/1988 | Bulatovic | 209/166 |
| 5,068,028 | 11/1991 | Miller | 209/166 |
| 5,108,495 | 4/1992 | Heimala | 209/166 |
| 5,110,455 | 5/1992 | Huch | 209/166 |

FOREIGN PATENT DOCUMENTS

| | | | |
|---|---|---|---|
| 1104274 | 6/1981 | Canada | 209/167 |
| 1238430 | 6/1988 | Canada | 209/167 |
| 1243349 | 10/1988 | Canada | 209/166 |
| 141856 | 11/1981 | Japan . | |
| 340598 | 1/1931 | United Kingdom | 209/166 |
| 1434545 | 5/1976 | United Kingdom | 209/166 |

OTHER PUBLICATIONS

"Chemistry" 2nd Edition ©1984 Academic Press pp. 548, 549, 874, 875, 876.

Arthur F. Taggart; "Handbook of Mineral Dressing, Ores and Industrial Minerals"; pp. 12-112 through 12-116.

Iwasaki and A. S. Malicsi; "Use of Ozone in the Differential Flotation of Bulk Copper-Nickel Sulfide Concentrates"; published Feb. 1985 in journal entitled Minerals and Metallurgical Processing, pp. 68-72.

*Primary Examiner*—Thomas M. Lithgow

*Attorney, Agent, or Firm*—Sheridan Ross & McIntosh

[57] ABSTRACT

The present invention involves a method for separating a first copper-containing mineral from a second copper-containing mineral using froth flotation where one of the minerals has a more readily oxidizable surface than the other. Prior to flotation, a slurry containing the copper-containing minerals is oxidized and conditioned to achieve an effective pH. Thereafter, the slurry is subjected to a froth flotation process by which a first copper-containing mineral, such as chalcocite, and a second copper-containing mineral, such as enargite, are recovered.

20 Claims, 1 Drawing Sheet

METHOD FOR ACHIEVING ENHANCED COPPER-CONTAINING MINERAL CONCENTRATE GRADE BY OXIDATION AND FLOTATION

This application is a continuation-in-part of U.S. patent application Ser. No. 07/626,825, filed Dec. 13, 1990 now, U.S. Pat. No. 5,110,455 issued May 5, 1992.

FIELD OF THE INVENTION

The present invention relates to the separation of minerals by froth flotation, and in particular, a method for separating a mineral that has a surface more readily oxidizable from a mineral having a less oxidizable surface, such as the separation of chalcocite ($Cu_2S$) from enargite ($Cu_3AsS_4$).

BACKGROUND OF THE INVENTION

A major operation in mineral processing involves the separation of desirable minerals from ore bodies within which the minerals are contained. Froth flotation is a common technique employed to facilitate such separation. In froth flotation, ground ore is typically fed as an aqueous slurry to froth flotation cells. The chemistry of the slurry is adjusted such that certain minerals selectively attach to air bubbles which rise upward through the slurry and are collected in froth near the top of a flotation cell. Thereafter, minerals in the froth can be separated from different minerals in the cell.

The surfaces of specific mineral particles in aqueous suspension are treated with chemicals called flotation reagents or collectors. Flotation reagents provide the desired mineral to be floated with a water-repellent air-avid coating that will easily adhere to an air bubble, which will raise the mineral through the slurry to the surface. The minerals are trapped within froth which is generated by vigorous agitation and aeration of the slurry in the presence of a frothing agent. The valuable mineral separated and collected during the flotation process may be either the froth product or the underflow product.

Other chemical agents, such as depressants or modifiers, can also be added to the slurry to aid in mineral separation. The presence of depressants generally assists in selectivity and/or stops unwanted minerals from floating. Modifiers facilitate collection of desired minerals. Modifiers include several classes of chemicals such as activators, alkalinity regulators and dispersants. Activators are used to make a mineral surface amenable to collector coatings. Alkalinity regulators are used to control and adjust pH, an important factor in many flotation separations. Dispersants are important for control of slimes which sometimes interfere with selectivity and increase reagent consumption.

One difficulty encountered in froth flotation is the separation of a first copper-containing mineral from a second copper-containing mineral. Typically, two such minerals will collect together during traditional froth flotation. An example of such minerals are chalcocite and enargite.

Generally, a copper-containing mineral slurry is conditioned to achieve an effective pH, that is a pH that will help effectuate desired mineral separation. The slurry is subjected to a copper flotation process, using a collector and frother as required. However, when a slurry contains a first and second copper-containing minerals with similar flotation characteristics, the process is unsatisfactory due to inefficiency in achieving the desired copper-containing mineral separation. Specifically, the separation of chalcocite from enargite using a traditional flotation process is typically unsuccessful because both minerals will generally float.

Practitioners of the froth flotation art have sought to separate desired copper-containing minerals from a second similarly floatable copper-containing mineral, but have met with limited success. One method which has been employed to enhance the separation of such minerals is to grind the mineral containing ore to an extremely fine size, e.g., less than 625 mesh. In this way, particles are formed which typically have surface characteristics of a base mineral, allowing conventional flotation techniques to be utilized. However, it is relatively expensive to grind the minerals to such an extremely fine size, and the degree of separation is often times still less than desired.

As a result, it would be advantageous to have a process for efficiently and economically separating a desired copper-containing mineral from a second copper-containing mineral having similar flotability characteristics. In particular, it would be advantageous to have a froth flotation process for effectively separating chalcocite from enargite, since it is known in the art that a high grade enargite concentrate can be economically processed using a special smelting process. Likewise, a high grade chalcocite concentrate, mostly free from enargite, can also be efficiently smelted. It would also be advantageous if the process for separating copper-containing minerals could be accomplished using ordinary flotation equipment, to produce a high grade desired copper-containing mineral concentrate.

SUMMARY OF THE INVENTION

The present invention provides a method for concentrating a copper-containing mineral from a slurry containing a first copper-containing mineral and a second copper-containing mineral where the surface of one of the minerals is more readily oxidizable than the other. Generally, the invention first requires that the mineral-containing slurry is oxidized. Next, the slurry is conditioned to achieve an effective pH. Last, the slurry is subjected to a flotation process.

In accordance with an embodiment of the present invention, a method for enhanced separation of chalcocite from enargite by use of a froth flotation process is disclosed. The present process provides numerous advantages, including the ability to recover higher concentrations of chalcocite and enargite in a more efficient and effective manner than has previously been available. In a preferred embodiment of the present process, an aqueous suspension of concentrate, including chalcocite and enargite, is conditioned with an oxidizing agent. Examples of such oxidizing agents include peroxides (preferably hydrogen peroxide), ozone and persulfates. Next, the slurry is subjected to a froth flotation process by which chalcocite is depressed and selectively collected as underflow product, the enargite is collected as the froth product.

It is believed that the new process results in a purer chalcocite and enargite concentrate than has been previously obtained. The various concentrates can be subjected to normal recovery processes, such as smelting. Due to the higher concentration of desired copper-containing minerals in the concentrate, a higher percentage of pure copper can be recovered, rendering the various copper-containing mineral smelting processes more efficient and cost effective.

DETAILED DESCRIPTION OF A PREFERRED EMBODIMENT

Figure 1:
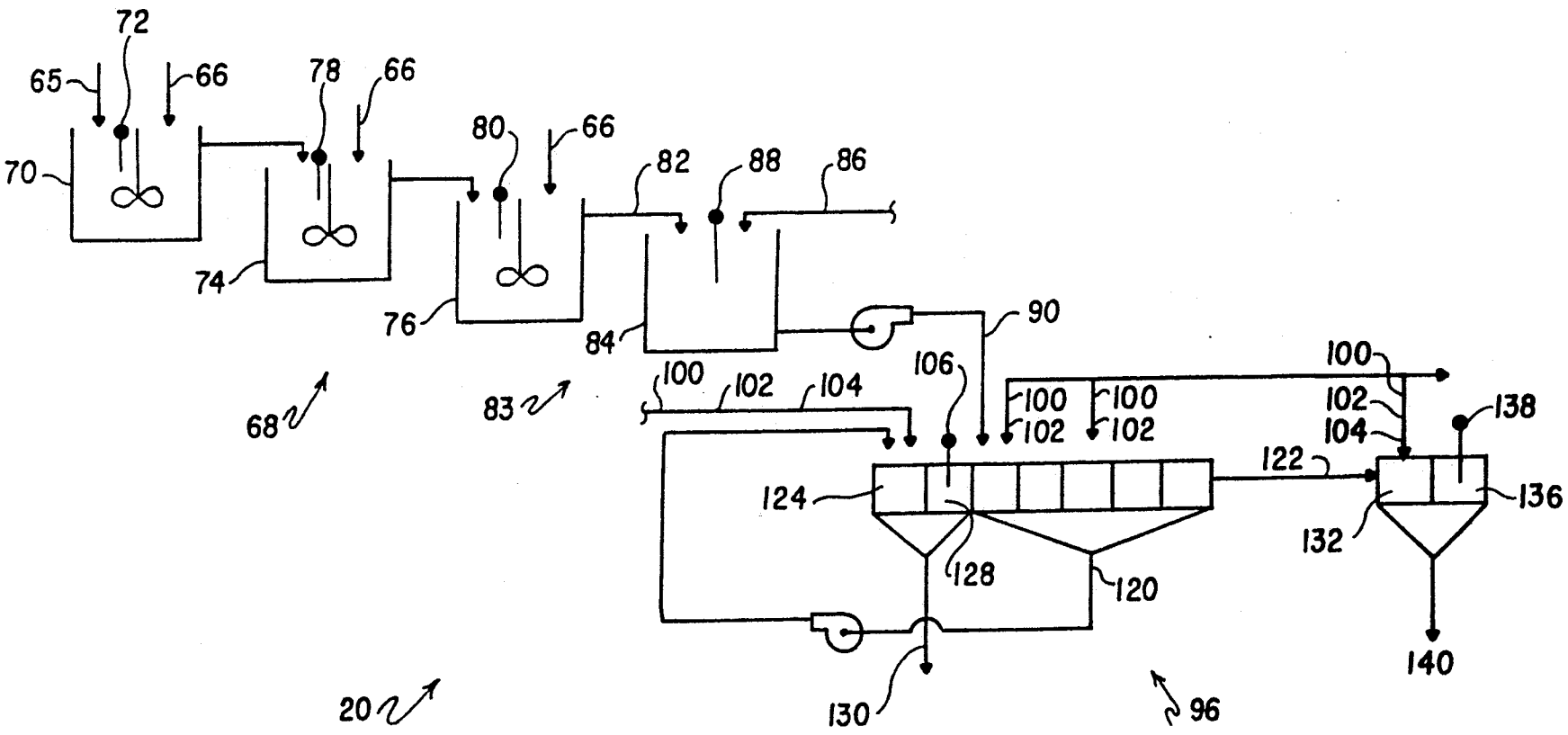
FIG. 1 illustrates an embodiment of the flotation separation process of the present invention.

The present invention will be discussed in terms of a preferred embodiment, the recovery of chalcocite from enargite. However, it should be understood that this limited disclosure is for purposes of clarity. The present invention is capable of application to the separation of other first copper-containing minerals from second copper-containing minerals. The present process would also be advantageous in the separation of a number of minerals wherein there are two minerals which typically float or depress together, but differ in their surface oxidation properties.

The present invention is useful in the separation of a first copper-containing mineral from a second copper-containing mineral with similar flotation characteristics, such as chalcocite from enargite, using a froth flotation process. In a preferred embodiment, a slurry containing the mineral concentrate is conditioned with an oxidizing agent, such as peroxide, ozone or persulfate. The slurry is then pH conditioned to achieve an effective pH. An effective pH is a pH that will effectuate separation of a first copper-containing mineral from a second copper-containing mineral. This process oxidizes and depresses the chalcocite for collection as the underflow product, while the enargite floats and is recovered as the froth product.

With reference to FIG. 1, a preferred embodiment of the ore flotation separation process is illustrated. The apparatus 20 receives a slurry of ground concentrate 65, including chalcocite and enargite. The chalcocite is separated from enargite by the novel process of the present invention.

The concentrate 65 containing chalcocite and enargite is obtained by first removing easily separable chalcocite, enargite and gangue. The concentrate 65 is transferred to an oxidation and pH adjustment circuit 68. The concentrate 65 is held in aqueous suspension in tank 70 while an oxidant 66 (preferably hydrogen peroxide ($H_2O_2$)) is added thereto. Alternative oxidizing agents, such as other peroxides, ozone and persulfates can be employed. Oxidant 66 is added while a first oxidation reduction potential (ORP) monitor 72 continuously monitors the ORP level.

It is preferred to adjust the ORP level in a stepwise manner. Therefore, as the slurry flows from tank 70 through tank 74 to tank 76, the ORP level is monitored by the first, second and third oxidation reduction potential monitors 72, 78, and 80 and appropriate amounts of oxidant 66 are added to raise or maintain the ORP level. Consequently, once the oxidized concentrate 82 leaves tank 76, the ORP level should be properly adjusted, for example, to between approximately +30 millivolts and approximately +100 millivolts.

The appropriate ORP level will vary depending on the concentrate and can easily be determined without undue experimentation. The ORP level should be greater than 0, and is preferably +20 to +700 millivolts and, more preferably, is +50 to +200 millivolts. Although the amount of oxidant 66 which must be added to the concentrate 65 in order to obtain the desired ORP level can vary widely amounts varying from about 1 to about 100 pounds of hydrogen peroxide per ton of ore can be employed successfully. The optimum amount of oxidant will be the lowest amount which provides the desired separation of chalcocite from enargite. When determining the optimum ORP level, one can raise the ORP level in small millivolt increments until maximum separation in the subsequent flotation stage 96 is obtained.

The pH level of the oxidized concentrate 82 is adjusted in the pH adjustment stage 83. The oxidized concentrate 82 from tank 76 is transferred to the pH adjustment tank 84. A base such as lime (CaO) or hydrated lime ($Ca(OH)_2$) or acid such as sulfuric acid ($H_2SC_4$) may be added to the slurry by means of the pH adjustment system 86. The pH adjustment agent is added to the slurry until the pH sensing monitor 88 signals that the pH has been properly adjusted to achieve effective separation. The desired pH will depend upon the concentrate 65 and the collector 102 employed in the subsequent flotation stage 96. Different collectors work most efficiently at different pHs. The optimum pH is the lowest basic or highest acid pH at which effective separation of chalcocite from enargite occurs in the subsequent flotation stage 96.

The properly oxidized and pH adjusted slurry 90 is transferred to the final, flotation circuit 96. A frother 100 (e.g. MIBC) and copper collector 102 (e.g. a xanthate such as sodium and potassium salts of amyl, isopropyl and ethyl xanthate) are added to the slurry to aid in the separation of chalcocite from enargite. As the slurry travels through the cells, enargite concentrate 120 is floated and collected while chalcocite is collected as the underflow concentrate 122, both concentrates may still contain residual amounts of either chalcocite or enargite.

The enargite concentrate 120 is subjected to a second flotation stage in cells 124 and 128, to obtain the final enargite concentrate 130. Additional frother 100, collector 102 and pH adjustment agent 104 can be added to cell 124. The pH can be monitored by a second pH meter 106 in cell 128. The chalcocite concentrate 122 is also subjected to a second flotation stage in cells 132 and 136, to obtain the final chalcocite concentrate 140. Additional frother 100, collector 102 and pH adjustment agent 104 can be added to cell 132. The pH can be monitored by a third pH meter 138 in cell 136. The final enargite concentrate 130 and final chalcocite concentrate 140 can be subjected to appropriate mineral recovery processes, such as smelting, in order to obtain a pure mineral product.

It is important to add appropriate amounts of collector 102, which in one embodiment is xanthate, to maximize the separation of desired minerals in the final chalcocite concentrate 140 and enargite concentrate 130. If too little collector is added, a less than desirable amount of enargite will float, resulting in too much enargite in the underflow product 140. In order to maximize desired copper-containing mineral recovery, it is advantageous to assay (e.g. by x-ray analysis) both the floated enargite concentrate 130 and the chalcocite concentrate 140.

It is known that desired copper-containing minerals may float together with undesired second copper-containing minerals, when subjected to traditional froth flotation. While not wishing to be bound by any theory, it is believed that the addition of an oxidant, such as hydrogen peroxide, ozone or persulfate, oxidizes and depresses easily oxidizable minerals, while not affecting the floatability of less oxidizable minerals. It has also been found that adjusting the pH to a proper level after addition of the oxidant may be important to achieve flotation selectivity.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A method for concentrating enargite from a slurry containing enargite and chalcocite, said method comprising:

(a) conditioning the slurry with an effective amount of an oxidizing agent to depress said chalcocite; and (b) subjecting the slurry to a froth flotation process to float an enargite concentrate from said slurry, resulting in an enargite concentrate as a flotation product separate from a chalcocite concentrate as an underflow product.

2. A method, as claimed in claim 1, wherein said oxidizing agent is a peroxide.

3. A method, as claimed in claim 1, wherein said oxidizing agent is hydrogen peroxide.

4. A method, as claimed in claim 1, wherein said oxidizing agent is ozone.

5. A method, as claimed in claim 1, wherein said oxidizing agent is a persulfate.

6. A method, as claimed in claim 1, wherein said slurry is conditioned with an oxidizing agent for a time greater than 1 minute.

7. A method, as claimed in claim 1, wherein said slurry is conditioned with an oxidizing agent for a time from about 5 minutes to about 120 minutes.

8. A method, as claimed in claim 1, wherein said slurry is conditioned with an oxidizing agent sufficient to achieve an oxidation reduction potential greater than 0 millivolts.

9. A method, as claimed in claim 8, wherein said oxidation reduction potential is from about +20 millivolts to about +700 millivolts.

10. A method, as claimed in claim 8, wherein said oxidation reduction potential is from about +50 millivolts to about +200 millivolts.

11. A method, as claimed in claim 1, wherein said flotation process includes the step of adding a copper collector in an amount based on measuring at least one of: (1) the concentration of enargite in the chalcocite concentrate; or (2) the concentration of chalcocite in the enargite concentrate.

12. A method for recovering chalcocite from a slurry containing chalcocite and enargite, said method comprising:

(a) conditioning the slurry with an effective amount of an oxidizing agent to depress the enargite, said oxidizing agent is selected from the group consisting of peroxide, persulfate and ozone; and (b) subjecting the oxidized slurry to a froth flotation process to float enargite from said slurry to create a floated enargite concentrate and an underflow chalcocite concentrate.

13. A method, as claimed in claim 12, wherein said flotation process includes the step of adding the copper collector in an amount based on measuring at least one of: (1) the enargite concentration in the chalcocite concentrate; or (2) the concentration of chalcocite in the enargite concentrate.

14. A method, as claimed in claim 12, wherein said oxidizing agent is hydrogen peroxide.

15. A method, as claimed in claim 12, wherein said slurry is conditioned with an oxidizing agent for a time greater than 1 minute.

16. A method, as claimed in claim 12, wherein said slurry is conditioned with an oxidizing agent for a time from about 5 minutes to about 120 minutes.

17. A method, as claimed in claim 12, wherein said slurry is conditioned with an oxidizing agent sufficient to achieve an oxidation reduction potential greater than 0 millivolts.

18. A method, as claimed in claim 17, wherein said oxidation reduction potential is from about +20 millivolts to about +700 millivolts.

19. A method, as claimed in claim 17, wherein said oxidation reduction potential is from about +50 millivolts to about +200 millivolts.

20. A method for concentration enargite and chalcocite from a slurry which contains both, said method comprising:

(a) conditioning the slurry with a sufficient amount of peroxide to achieve an oxidation reduction potential greater than 0 millivolts and to depress said chalcocite, said conditioning of said slurry to last for a time greater than about 1 minute; and (b) subjecting said slurry to a froth flotation process wherein a copper collector is added to said slurry to float an enargite concentrate from an underflow chalcocite concentrate.

* * * * *